US009984833B2

(12) United States Patent
Kaltenborn et al.

(10) Patent No.: US 9,984,833 B2
(45) Date of Patent: May 29, 2018

(54) SWITCHING SYSTEM WITH PRESELECTOR

(71) Applicant: MASCHINENFABRIK REINHAUSEN GMBH, Regensburg (DE)

(72) Inventors: Uwe Kaltenborn, Regensburg (DE); Thomas Strof, Gumboldskirchen (AT); Christian Hurm, Regensburg (DE); Anatoli Saveliev, Zeitlarn (DE); Gerhard Baeuml, Regenstauf (DE); Alfred Bieringer, Geiselhoering (DE); Eduard Zerr, Regensburg (DE); Wolfgang Albrecht, Wenzenbach (DE); Martin Hausmann, Lappersdorf (DE); Andreas Stocker, Neutraubling (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 83 days.

(21) Appl. No.: 14/915,361

(22) PCT Filed: Sep. 26, 2014

(86) PCT No.: PCT/EP2014/070586
§ 371 (c)(1),
(2) Date: Mar. 27, 2016

(87) PCT Pub. No.: WO2015/044325
PCT Pub. Date: Apr. 2, 2015

(65) Prior Publication Data

US 2016/0211089 A1 Jul. 21, 2016

(30) Foreign Application Priority Data

Sep. 26, 2013 (DE) ..... 10 2013 110 656

(51) Int. Cl.
*H01F 21/12* (2006.01)
*H01F 21/02* (2006.01)
(Continued)

(52) U.S. Cl.
CPC ..... *H01H 9/0027* (2013.01); *H01F 29/04* (2013.01); *H01H 9/0011* (2013.01); *H01H 9/0016* (2013.01); *H01H 9/0038* (2013.01)

(58) Field of Classification Search
USPC ..... 336/138–145, 150
See application file for complete search history.

(56) References Cited

U.S. PATENT DOCUMENTS 3,581,188 A * 5/1971 Watanabe ..... H01F 27/40 323/340
3,609,516 A * 9/1971 Nagatoshi ..... H01F 29/06 336/144

(Continued)

FOREIGN PATENT DOCUMENTS

GB 1394913 A 5/1975

*Primary Examiner* — Mangtin Lian
*Assistant Examiner* — Kazi Hossain
(74) *Attorney, Agent, or Firm* — Andrew Wilford

(57) ABSTRACT

The invention relates to a step switch, comprising a pre-selector and a fine selector. The invention is characterized in that the step switch has a connection (36) between the pre-selector and the fine selector (18), at least one coupling switch (38) being arranged in said connection. A pre-selector can be switched in a largely gas-free manner by means of said switchable connection with the aid of the fine selector.

8 Claims, 4 Drawing Sheets

(51) Int. Cl.
*H01H 9/00* (2006.01)
*H01F 29/04* (2006.01)

(56) References Cited

U.S. PATENT DOCUMENTS

| | | | | | |
|---|---|---|---|---|---|
| 3,662,253 | A * | 5/1972 | Yamamoto | H01F 29/04 | 323/343 |
| 4,061,963 | A * | 12/1977 | Green | H01F 29/04 | 361/35 |
| 4,081,741 | A * | 3/1978 | Palmer | H01F 29/04 | 323/340 |
| 6,849,813 | B1 * | 2/2005 | Albrecht | H01H 9/0044 | 200/11 TC |
| 8,576,038 | B2 | 11/2013 | Kraemer | | |
| 2006/0039171 | A1 * | 2/2006 | Lavieville | H01F 29/04 | 363/19 |
| 2012/0249277 | A1 * | 10/2012 | Kraemer | H01F 29/04 | 336/145 |

* cited by examiner

SWITCHING SYSTEM WITH PRESELECTOR

CROSS REFERENCE TO RELATED APPLICATIONS

This application is the US-national stage of PCT application PCT/EP2014/070586 filed 26 Sep. 2014 and claiming the priority of German patent application 102013110656.0 itself filed 26 Sep. 2013.

FIELD OF THE INVENTION

The present invention relates to a tap changer, such as usually used in a control transformer, which comprises at least one primary winding and control winding.

BACKGROUND OF THE INVENTION

A typical such tap changer has at least one fine selector for connection of a plurality of taps of the control winding, and also at least one preselector that is connected with the primary winding and by which the control winding is connectable in a different polarity with the primary winding. Through the series connection that is effected by means of the tap changer, of the primary winding with the control winding it is possible to tap desired different voltages in correspondence with the tapping of the control winding. It is possible in this way to freely select the input/output voltage of the control transformer in a desired range. A tap changer of that kind is needed for each phase of the three-phase current. The tap changer is usually constructed as a rotary switch. The preselector and fine selector can be constructed to be integrated on the axle of the rotary switch. The fine selector is usually formed by fine selector contacts arranged on different planes of a rotary switch. On each plane, each second tap of the control winding is respectively connected in alternation. Switching takes place between the fine selector contacts, which are arranged on the two planes, by a load changeover switch that is known per se and usually includes switching resistances. An arrangement of that kind is described in, for example, DE 10 2009 060 132 [U.S. Pat. No. 8,576,038]. However, the fine selector can also be formed by a fine selector contact that connects all contacts, which are arranged on a plane, of the control winding. This fine selector contact can also comprise switching resistances.

There is now a problem with, in particular, switching the preselector, i.e. if the polarity of the control winding has to be changed by means of the preselector. In that case, the connection of the preselector with a first winding end of the control winding is switched to a connection with the second winding end of the control winding. This switching process is, in fact, usually carried out in current-free state, yet voltages are induced not only in the primary winding, but also in the control winding and these voltages can lead, together with the capacitive coupling of the windings with one another and with earth, to an arc and thus to generation of gas during switching of the preselector.

OBJECT OF THE INVENTION

It is therefore an object of the invention to create a tap changer that enables at least largely gas-free switching of the preselector.

SUMMARY OF THE INVENTION

In accordance with the invention an electrical connection, in which at least one coupling switch is present, is arranged between the preselector and the fine selector.

Through this coupling switch the fine selector itself can now be connected with the preselector and the switching process of the preselector from one end of the control winding to the other end can be carried out with the assistance of the fine selector in that there is switching from one end of the control winding, for example by all taps of the control winding, to the other end. The advantage in that case is due to the fact that the fine selector can switch, through a load changeover switch or an auxiliary switch, between the individual winding taps in at least largely gas-free manner and without interruption. In addition, the switching process can take place not by the entire winding of the control winding, but in each instance always only from one tap to the next so that the potential difference during switching from one tap to the other is significantly smaller. If, for example, a control winding has ten taps, then during switching from one tap to the next only a tenth of the potential difference of the entire voltage of the control winding is present on each occasion. Moreover, a load changeover switch is often provided at fine selectors so that the switching between the taps of the control winding can be carried out not only in gas-free manner, but also free of interruption. During the switching of the fine selector by the taps the preselector remains in a neutral setting in which it does not contact either of the two ends of the control winding. Since the preselector, by virtue of the connection with the closed coupling switch, lies at the same potential as the load diverter of the fine selector, resetting of the preselector to the other end of the control winding takes place free of potential, i.e. without arcs. Thus, an arc-free and consequently gas-free switching of the preselector is made possible by the invention.

The electrical connection between preselector and fine selector is preferably a direct electrical connection, for example a line or a conductor track. However, apart from the coupling switch, electrical components such as, for example, electrical filters, coils, resistances, capacitors, etc., can also be arranged in the electrical connection.

The preselector preferably has at least one movable switching element and two switch contacts contactable by the switching element, wherein the electrical connection permanently contacts the switching element. The switching element is normally connected with the primary winding and the switch contacts with the two ends of the control winding. The electrical connection thus connects the switching element of the preselector with the primary winding and the fine selector. Since the fine selector, during switching of the preselector, contacts the same end of the control winding as the switching element of the preselector this has the consequence that separation of the switching element of the preselector from the switch contact takes place free of potential in a neutral, non-contacting setting and thus without generation of an arc and corresponding induction of gas into a surrounding coolant, for example oil.

The preselector preferably comprises at least one switching element mechanically or electrically coupled with at least one switching element of the coupling switch. In this way, correlated actuation of the two switching elements of the preselector and the coupling switch can take place in simple interlinked manner so that faulty operations are excluded. The coupling is thus preferably such that the switching element of the preselector is set, after closing of the switching element of the coupling switch, into a neutral setting in which the preselector is not connected with either of the ends of the control winding. This has the purpose of excluding the preselector from the entire switching process that is now realized by the fine selector itself.

Further, in an advantageous development of the invention the coupling is such that the switching element of the coupling switch opens after closing of the switching element of the preselector. If at the end of the switching process the switching element of the preselector is contacted with the other end of the control winding, to which the fine selector had previously been switched, the coupling switch is thus automatically opened.

As already mentioned above, gas-free switching of the fine selector can take place through a load changeover switch known per se. It is also possible to use a fine selector without a load changeover switch that switches in one plane. This usually comprises a fine selector contact with switching resistances so as to in this way ensure gas-free switching from one tap to the next. However, instead of or additionally to the switching resistances it can also be provided with one or more vacuum interrupters. In this respect it is to be noted that the load changeover switch is often located in an individual oil-tight and gas-tight vessel.

The load changeover switch preferably has at least one switching resistance so as to make the transition phase of switching from one tap to the next free of interruption. As a result, the control winding remains in contact with the primary winding so that no voltages, for example due to the capacitive coupling of the control winding relative to the primary winding, can arise. The fine selectors can preferably have a load changeover switch such as described in DE 10 2009 060 132. This enables gas-free switching processes of the fine selector.

In an advantageous development of the invention the tap changer, i.e. the preselector and/or the fine selector, is constructed as a rotary switch. An arrangement of that kind has proved advantageous for power transformers used in, in particular, the field of power supply. If several phases of a transformer are to be switched simultaneously, the corresponding phases can be arranged in succession in different planes of the rotary switch. Thus, for example, all three phases of a three-phase current can be switched simultaneously.

The tap changer, i.e. the preselector and/or the fine selector, is preferably constructed as a snap switch that makes possible short switching processes and reduces the transition time of switching from one tap to the next.

The preselector is preferably constructed as a reverser, the switching element of which is conceived for connection with the primary winding and the two switching contacts of which are conceived for contacting the two ends of the control winding. A preselector of that kind is very simple to realize in terms of circuitry and, in addition, reliable.

The invention additionally relates to a control transformer with at least one primary winding and at least one control winding of the kind described in the foregoing, in which control transformer the primary winding has a plurality of taps connectable by the fine selector and in which the preselector connects the control winding in desired manner with the primary winding.

In a method according to the invention for switching the preselector of a tap changer in a control transformer of the kind described in the foregoing the following sequence of steps is performed: a) the fine selector is, if required, moved to the end position of the preselector (in brief in the following: reverser) at the control winding. In this way, it is ensured that the fine selector is at the same potential as the reverser when the coupling switch is closed. If this is not the case, then a short-circuit corresponding with the difference in potential between the end of the control winding at which the reverser makes contact and the tap at which the tap changer is currently located can occur.

For switching the preselector, the coupling switch is switched from its open normal setting to a closed switching setting. Since the coupling switch is closed only for switching the preselector or reverser, the closed setting is also termed switching setting.

The preselector is now switched to a non-contacting neutral setting. Since the control winding is connected by the fine selector with the primary winding and the switching process has to be carried out by means of the fine selector, the preselector has to be brought into the non-contacting neutral setting, since otherwise a difference in potential between the reverser and the fine selector, which would short-circuit via the electrical connection and the coupling switch, arises. The fine selector is now switched through to the other end of the control winding by all taps of the control winding. This switching-through process takes place, as already mentioned, in at least largely gas-free manner by means of the auxiliary contacts, which may be present, or by means of a load changeover switch known per se. When the tap changer has reached the other end position at the control winding, the preselector is also switched to the new end position. In that case, due to the closed coupling contact the preselector lies at the same potential as the fine selector. The coupling switch is now re-opened to its normal setting. The arc-free and gas-free switching of the preselector is thereby concluded.

In order to simplify the method, it can preferably be provided that the switching element of the preselector is coupled with the switching element of the coupling switch so as to thus automate the sequence of actuation of reverser and coupling switch and thereby make it free of fault. In this way, the switching times, for example the times in which the two switching elements are closed before one of the two switching elements re-opens, can be set. Thus, through the coupling it is also possible to minimize dead times in the switching processes. An electrical or electronic control for actuation of the switching elements of the reverser and/or the coupling switch can obviously also be used.

The above forms of embodiment of the invention can be combined in any desired manner.

BRIEF DESCRIPTION OF THE DRAWING

The invention is now described by example on the basis of the schematic drawings, in which.

SPECIFIC DESCRIPTION OF THE INVENTION

Figure 1:
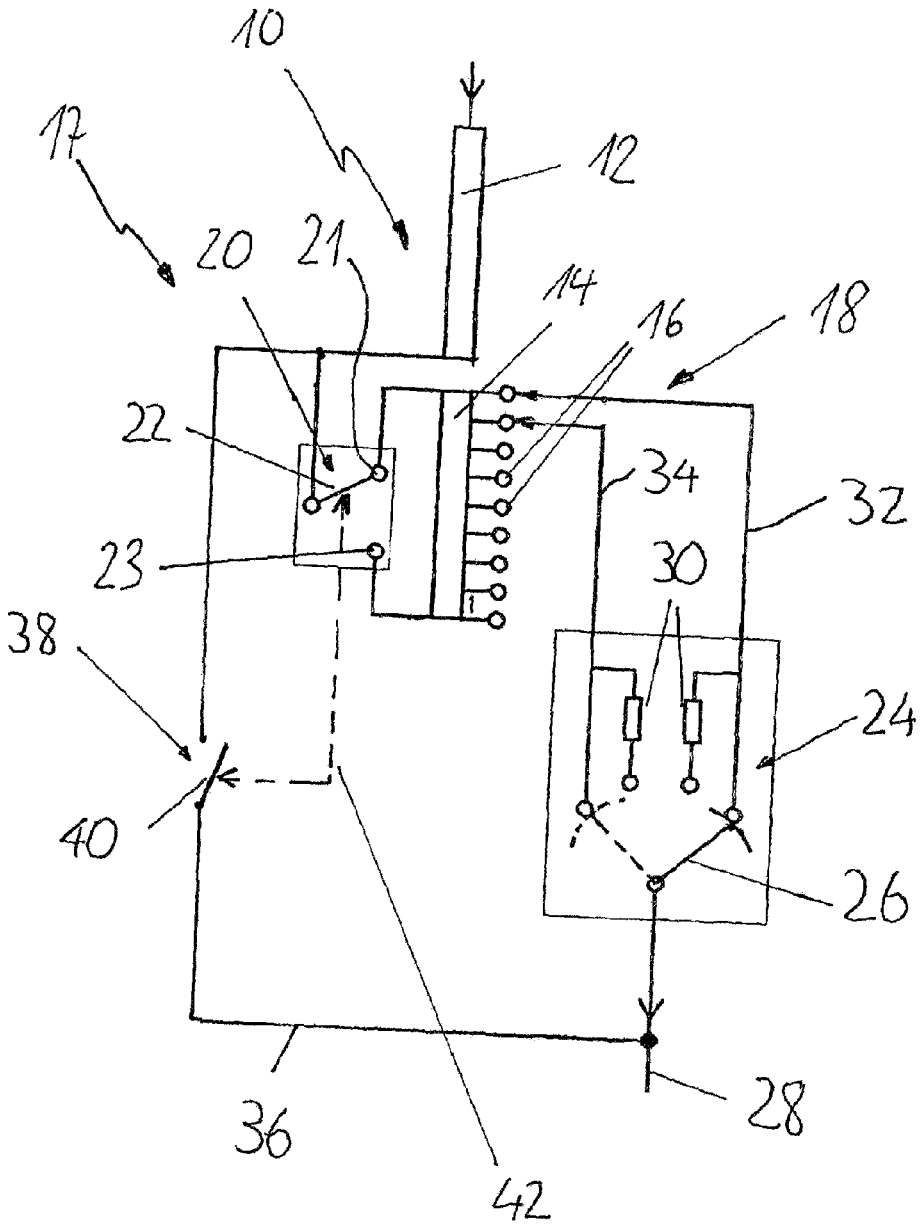
FIG. 1 shows a circuit diagram of a tap changer of a control transformer with a primary winding and control winding, which tap changer comprises a preselector, fine selector, load changeover switch and coupling switch.

The control transformer 10 comprises a primary winding 12 and a control winding 14 with a plurality of taps 16. A tap changer 17 consisting of a preselector 20 and a fine selector 18 is arranged in the control transformer 10. The fine selector 18 in turn consists of fine selector contacts 32, 34 and a load changeover switch 24 that switches between the fine selector contacts 32, 34. The preselector 20 is constructed as a reverser. The preselector 20 connects the control winding 14 with the primary winding 12 in desired polarity and the fine selector 18 preselects, by the fine selector contacts 32, 34, the taps 16 of the control winding 14 to be connected, in which case switching between the fine selector contacts 32, 34 is effected in this embodiment by the load changeover switch 24. The primary winding 12 is connected with the switching element 22 of the preselector 20, and the switch contacts 21, 23 thereof are connected with the ends of the control winding 14. The switching element 22 of the preselector 20 thus selectably connects one of the two ends of the control winding with the primary winding 12 by the switch contacts 21, 23 or it remains in a non-contacting neutral setting, as shown in FIGS. 2*c* and 2*d*.

The fine selector 18 is connected with a load diverter 28 by the load changeover switch 24. The load changeover switch 24 comprises a slide switch that contacts the two fine selector contacts 32, 34 in alternation with a short transition phase and with utilization of switching resistances 30 of the load changeover switch 24. The load changeover switch 24 thus includes two switching resistances 30, each of which is connected with a respective one of the fine selector contacts 32, 34. In this way the slide switch element 26 moves across four contacts of the load changeover switch 24, in which case there is switching from one tap 16 to the next tap 16 of the control winding 14 with interposition of the switching resistances 30. Before the actual switching process in the load changeover switch 24, the taps to be connected are preselected in voltage-free manner by the fine selector contacts 32, 34. Thus, with each switching process the slide switch element 26 moves from the illustrated right-hand end position in the load changeover switch 24 to the lefthand end position (dashed-line illustration) and vice versa. Other components and switching sequences can also be used in the load changeover switch 24, for example vacuum interrupters with auxiliary switches. Moreover, the tap changer 17 can also be constructed as a so-called load selector in which the fine selector 18 consists of the load changeover switch 24 and the fine selector contacts 32, 34. Preselection of the tap 16 to be connected and the load switching process are here carried out in one step.

According to the invention the fine selector 18 is now connected by an electrical connection 36 with the preselector (reverser) 20, preferably with the switching element 22 thereof. A coupling switch 38, by which the connection between the load diverter 28 of the load changeover switch 24 and the primary winding 12 can be interrupted, is arranged in this connection 36. The switching element 40 of the coupling switch 38 is preferably coupled with the switching element 22 of the reverser 20 by a mechanical or electrical coupling 42, whereby actuation thereof can be synchronized. The switching element can be constructed as a vacuum interrupter or snap contact. Switching of the reverser in a tap changer 17 as described above is explained in the following FIGS. 2*a*-2*f*.

Identical or functionally equivalent parts are provided in the figures with the same reference numerals. The load changeover switch 24 is illustrated only very schematically in the schematic drawing sequences of FIGS. 2*a*-2*f*.

Figure 2A:
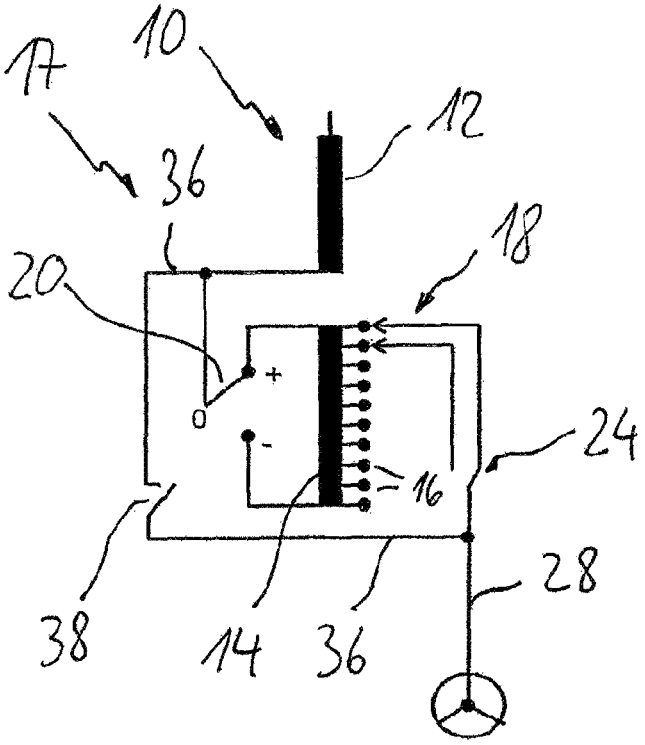
FIGS. 2*a-f* show a series of circuit diagrams for clarification of the switching process of the preselector with the help of the fine selector, for example in a control transformer of FIG. 1.
Figure 2B:
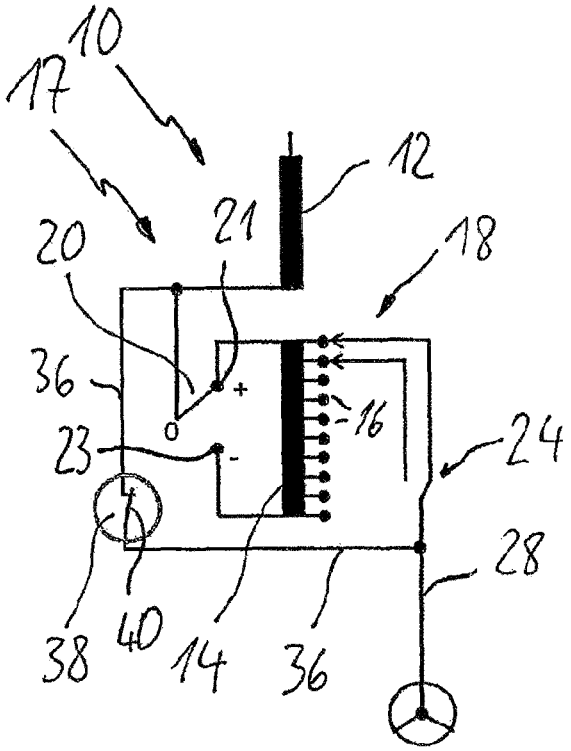
Figure 2C:
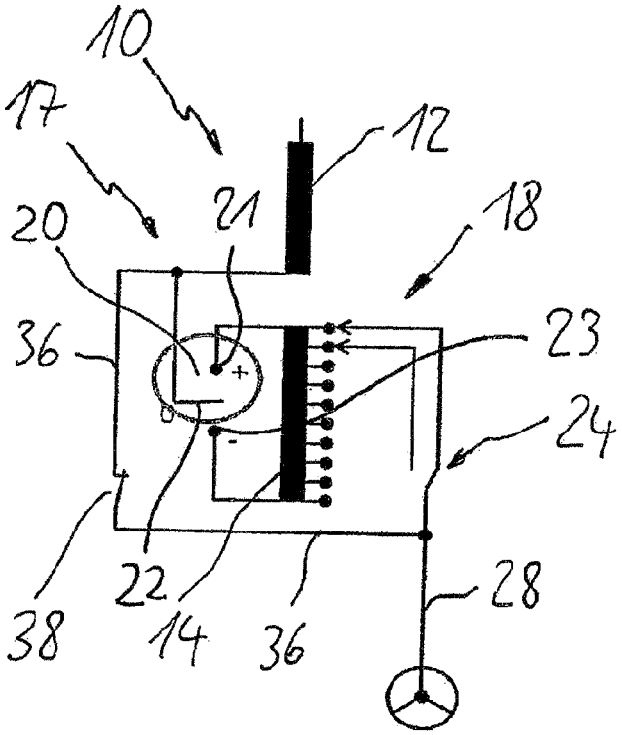
Figure 2D:
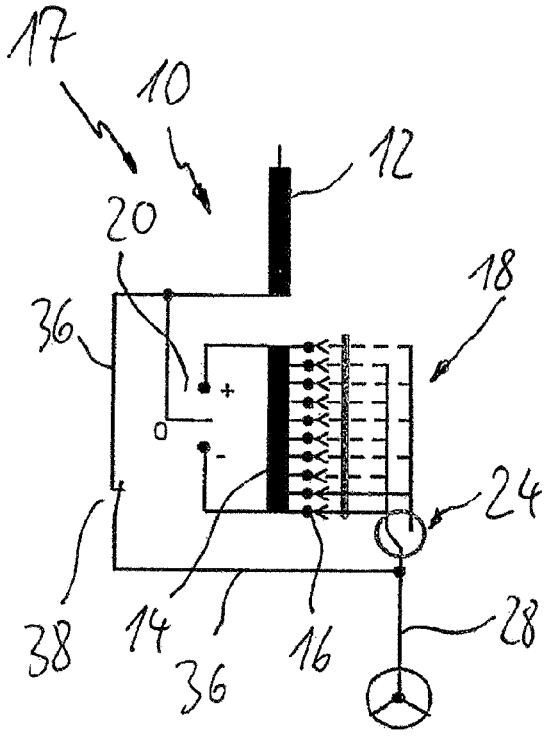
Figure 2E:
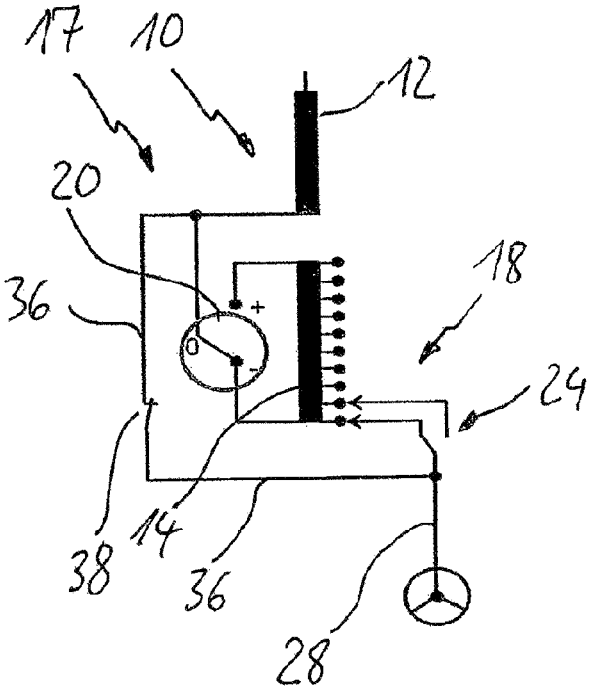

FIG. 2*a* shows the normal operating setting of the tap changer 17, in which the coupling switch 18 is opened, so that the voltage at the load diverter 28 of the load changeover switch 24 corresponds with the voltage corresponding with the tap 16 of the control winding 14 and the corresponding voltage component of the primary winding 12.

Figure 2F:
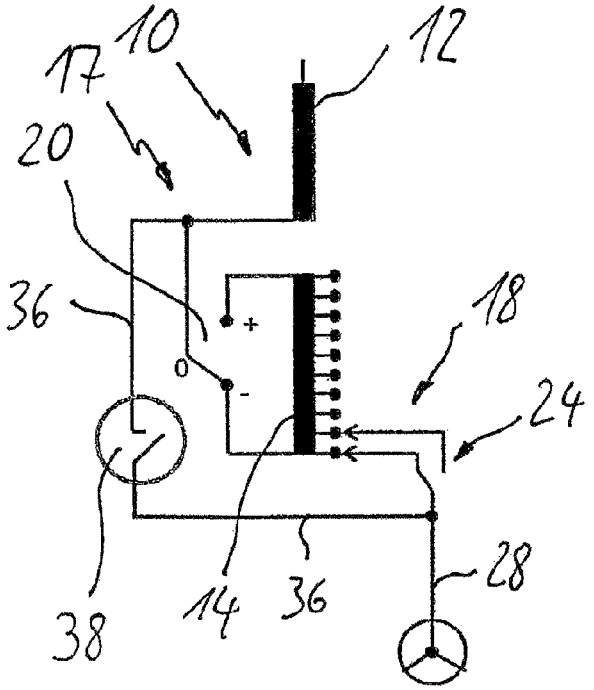

For the switching of the preselector 20, i.e. for switching over the polarization of the control winding 14, the coupling switch 38 is closed (FIG. 2*b*) when the fine selector 18 lies on the winding tap 16 that corresponds with the contact position of the reverser 20, of the control winding 14. The switching element 22 of the reverser 20 is now switched to a non-contacting neutral position as shown in FIG. 2*c*. The switching elements 40 of the coupling switch 38 and the switching element 22 of the reverser 20 can be coupled together so that the opening and closing of the switching elements takes place in coupled manner, i.e. with constrained synchronisation. In a preferred form of embodiment the actuation can take place by a transmission (not illustrated here) arranged between load changeover switch and selector. Moreover, it is possible for the actuation to be derived directly from the preselector 20. In this way faulty operation of the corresponding switching elements is excluded. In the switching phase illustrated in FIG. 2*c* the control winding 14 is now connected solely by the fine selector 18 and load changeover switch 24 with the primary winding 12. The fine selector 18 now moves, by means of the fine selector contact 32, 34 in conjunction with actuation of the load changeover switch 24, to the other end position of the control winding 14 as illustrated in FIG. 2*d*. In that case, the load changeover switch 24 always switches back and forth between the two fine selector contacts 32, 34 after the fine selector has preselected the 'next' tap. When the fine selector has switched through to the other end of the control winding 14, the switching element 22 of the reverser 20 is in turn switched into the contact setting with respect to the other end of the control winding 14, at which the fine selector 18 and the load changeover switch 24 are present. Since the reverser 20, primary winding 12 and fine selector 18 together with the load changeover switch 24 lie by the closed coupling contact 38 at the same voltage level, this switching process of the reverser 20 also takes place in potential-free manner, i.e. without generating an arc and thus free of gas. After switching of the reverser according to FIG. 2*e*, the coupling switch 38 is now re-opened as illustrated in FIG. 2*f*. The control transformer 10 has now again reached its normal operating position; fine selector.

The invention is not limited to the illustrated embodiments, but can be varied within the scope of protection of the following claims. In that regard, instead of mechanical switching contacts such as, for example, vacuum interrupters, it is possible to use semiconductor switching elements such as, for example, IGBTs. These semiconductor switching elements can be used in the fine selector 18, load changeover switch 24, preselector 20 and the fine selector contacts 32, 34 for the switching.

The invention claimed is:

1. A tap changer comprising:

a preselector having a movable preselector switching element and two preselector switch contacts contactable by the movable preselector switching element;

a fine selector having a movable fine-selector switching element and at least two fine-selector switch contacts contactable by the movable fine-selector switching element;

at least one coupling switch between the preselector and the fine selector and having a movable coupling-switch switching element and a coupling-switch contact, the movable coupling-switch switching element or the coupling-switch contact being connected to a load output, the coupling-switch switching element being connected to the movable preselector switching element so that, when the movable coupling-switch switching element engages the coupling-switch contact, the movable preselector switching element disengages from the preselector contacts and is set to an unconnected neutral setting, and, when the movable preselector switching element contacts any of the preselector contacts, the movable coupling-switch contact element disengages from the coupling-switch contact.

2. The tap changer according to claim 1, further comprising:

a transmission for actuating the coupling switch and between the load changeover switch and fine selector.

3. The tap changer according to claim 1, wherein the fine selector contacts are snap switches or a vacuum interrupter.

4. The tap changer according to claim 1 wherein the tap changer is a rotary switch.

5. The tap changer according to claim 1, wherein the fine selector is a load selector.

6. The tap changer according to claim 1, wherein the preselector is as a reverser.

7. A control transformer with at least one primary winding and control winding, the transformer comprising a tap changer according to claim 1, wherein the control winding has a plurality of taps connectable by the fine selector and the preselector connects the control winding in a desired polarity with the primary winding.

8. A method of switching a preselector in a tap changer according to claim 1, the method comprising the following sequence of steps:

a) moving the fine selector to the end position of the preselector at the control winding, b) switching the coupling switch from an open normal setting to a closed switching setting, c) switching the preselector to a non-contacting neutral setting, d) switching the fine selector through by the taps of the control winding to the opposite end position at the control winding, e) switching the preselector to the end position at the control winding, at which the fine selector in contact, and f) opening the coupling contact to its normal setting.

* * * * *